US010272673B2

(12) United States Patent
Iida

(10) Patent No.: US 10,272,673 B2
(45) Date of Patent: Apr. 30, 2019

(54) PRINTING APPARATUS THAT CONTROLS A SEQUENCE OF A PRINT UNIT BASED ON A PREDICTED ELECTRICAL ENERGY AMOUNT NECESSARY TO EXECUTE THE SEQUENCE, AND RELATED CONTROL METHOD

(71) Applicant: CANON KABUSHIKI KAISHA, Tokyo (JP)

(72) Inventor: Kazuki Iida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/585,255

(22) Filed: May 3, 2017

(65) Prior Publication Data

US 2017/0334226 A1 Nov. 23, 2017

(30) Foreign Application Priority Data

May 18, 2016 (JP) ..... 2016-099817

(51) Int. Cl.
*B41J 2/045* (2006.01)
*B41J 29/02* (2006.01)
(Continued)

(52) U.S. Cl.
CPC ..... *B41J 2/04548* (2013.01); *B41J 2/01* (2013.01); *B41J 2/04568* (2013.01);
(Continued)

(58) Field of Classification Search
CPC ..... B41J 2/04548
See application file for complete search history.

(56) References Cited

U.S. PATENT DOCUMENTS 4,656,489 A * 4/1987 Sato ..... H04N 1/23 347/182
4,870,428 A * 9/1989 Kuwabara ..... B41J 2/355 347/179
(Continued)

FOREIGN PATENT DOCUMENTS

CN 1439946 A 9/2003
CN 103427448 A 12/2013
(Continued)

OTHER PUBLICATIONS

Search Report dated Nov. 6, 2017, issued in European Patent Application No. 17000732.2.
(Continued)

*Primary Examiner* — Shelby L Fidler
(74) *Attorney, Agent, or Firm* — Venable LLP

(57) ABSTRACT

A printing apparatus includes an electrical storage that is charged by power input from an external power supply, a print unit that sequentially executes, by discharging the power charged in the electrical storage, a plurality of sequences in an operation sequence for printing on a print medium, and a charge unit that charges the power in the electrical storage from a period beginning when execution of one sequence by the print unit ends, until a next sequence starts. A prediction unit predicts an electrical energy amount necessary to execute the next sequence, and a control unit controls the print unit to execute the next sequence in a case in which an electrical storage amount of the electrical storage becomes greater than a threshold based on the electrical energy necessary to execute the next sequence by charging of the electrical storage by the charge unit.

18 Claims, 7 Drawing Sheets

(51) Int. Cl.

| | |
|---|---|
| ***B41J 2/165*** | (2006.01) |
| ***B41J 29/393*** | (2006.01) |
| ***B41J 2/01*** | (2006.01) |
| ***B41J 23/00*** | (2006.01) |

(52) U.S. Cl.
CPC ..... *B41J 2/16517* (2013.01); *B41J 23/00* (2013.01); *B41J 29/02* (2013.01); *B41J 29/393* (2013.01)

(56) References Cited

U.S. PATENT DOCUMENTS

| | | | | |
|---|---|---|---|---|
| 6,851,781 | B2 * | 2/2005 | Yokoyama | B41J 29/393 347/14 |
| 2005/0135830 | A1 | 6/2005 | Koyama | |
| 2008/0117244 | A1 * | 5/2008 | Morton | B41J 2/345 347/14 |
| 2013/0033532 | A1 * | 2/2013 | Zhao | B41J 2/04548 347/1 |
| 2014/0307013 | A1 * | 10/2014 | Tokuda | B41J 23/34 347/5 |
| 2015/0273822 | A1 | 10/2015 | Teraji | |
| 2017/0077721 | A1 * | 3/2017 | Soriano Fosas | B41J 23/00 |

FOREIGN PATENT DOCUMENTS

| | | | |
|---|---|---|---|
| JP | 2007-248729 | A | 9/2007 |
| JP | 2010-259279 | A | 11/2010 |
| JP | 2014166736 | A * | 9/2014 |

OTHER PUBLICATIONS

Office Action dated Sep. 27, 2018, issued in Chinese Patent Application No. 201710303427.2.

* cited by examiner

PRINTING APPARATUS THAT CONTROLS A SEQUENCE OF A PRINT UNIT BASED ON A PREDICTED ELECTRICAL ENERGY AMOUNT NECESSARY TO EXECUTE THE SEQUENCE, AND RELATED CONTROL METHOD

This application claims the benefit of Japanese Patent Application No. 2016-099817, filed May 18, 2016, which is hereby incorporated by reference herein in its entirety.

BACKGROUND OF THE INVENTION

Field of the Invention

The present invention relates to a printing apparatus and a related control method, and more particularly, for example, to a printing apparatus for performing printing using power charged in an electrical storage, such as a multilayer capacitor, and a related control method for the printing apparatus.

Description of the Related Art

In a printing apparatus that frequently switches over between driving and stopping of a motor, a consumption current generally varies largely, and the acceptable current value of a power supply unit for driving the motor is determined based on the maximum current value in the variation.

To suppress the variation in consumption current, Japanese Patent Laid-Open No. 2010-259279 proposes the use of an electrical double layer capacitor. That is, when the consumption current of the motor, or the like, of a printing apparatus is small, the electrical double layer capacitor is charged, and, when the consumption current becomes large, charges charged in the electrical double layer capacitor are discharged and are used, thereby suppressing the variation in consumption current of the printing apparatus.

With this arrangement, if the consumption power of the printing apparatus at the time of a normal operation exceeds power supplied to the printing apparatus, the printing apparatus is intermittently stopped and set in a standby state. This ensures a time during which the voltage of the electrical double layer capacitor rises in the standby state, and, when the operation restarts after that, it is possible to compensate for a shortage of power of an external power supply by externally input power and power stored in the electrical double layer capacitor. As described above, according to Japanese Patent Laid-Open No. 2010-259279, it is possible to execute a print operation even with small input power by intermittently inserting a standby time.

In a printing apparatus, such as a printer, if the operation is stopped at an inappropriate timing, the quality of an image, or the like, may degrade. For example, in a printing apparatus having an arrangement of discharging ink onto a paper surface while scanning a carriage incorporating a printhead, if the operation of the printing apparatus is stopped while driving a carriage motor for moving the carriage, during a print operation, the carriage, in one scan, stops on the paper surface. To restart the print operation from this state, it is necessary to accelerate the carriage motor and to discharge ink from the printhead at the same time.

With this operation, print unevenness may occur between regions printed before and after the stop of the carriage in an image of a print result. Thus, from the viewpoint of achieving high-quality printing, driving of the carriage motor should not be stopped while moving the carriage for a print operation. As described in Japanese Patent Laid-Open No. 2010-259279, if movement of the carriage corresponding to one scan starts in a state in which the charge amount of the electrical double layer capacitor is insufficient, a shortage of power may occur during the one scan, and the carriage may stop the print operation during printing of the one scan.

SUMMARY OF THE INVENTION

Accordingly, the present invention is conceived as a response to the above-described disadvantages of the conventional art.

For example, a printing apparatus and a related control method according to this invention are capable of executing a sequence in an appropriate status with respect to an electrical storage amount.

According to one aspect, the present invention provides a printing apparatus for printing an image on a print medium, the printing apparatus comprising an electrical storage configured to be charged by power input from an external power supply, a print unit configured to sequentially execute, by discharging the power charged in the electrical storage, a plurality of sequences in an operation sequence for printing on the print medium, a charge unit configured to charge power in the electrical storage from when execution of one sequence among the plurality of sequences by the print unit ends until a next sequence starts, and a control unit configured to control the print unit to execute the next sequence in a case in which an electrical storage amount of the electrical storage becomes greater than a predetermined threshold by charging of the electrical storage by the charge unit.

According to another aspect, the present invention provides a control method for a printing apparatus for printing an image on a print medium using power of an electrical storage charged by power input from an external power supply, the control method comprising sequentially executing, by discharging the power charged in the electrical storage, a plurality of sequences in an operation sequence for printing on the print medium, charging power in the electrical storage from when execution of one sequence among the plurality of sequences ends until a next sequence starts, and controlling to execute the next sequence in a case in which an electrical storage amount of the electrical storage becomes electrical than a predetermined threshold by charging of the electrical storage.

The invention is particularly advantageous since it is possible to execute the next sequence in an appropriate status with respect to an electrical storage amount.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

In this specification, the terms "print" and "printing" not only include the formation of significant information, such as characters and graphics, but also broadly include the formation of images, figures, patterns, and the like, on a print medium, or the processing of the medium, regardless of whether they are significant or insignificant and regardless of whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (also referred to as a "liquid") should be extensively interpreted similar to the definition of "print" described above. That is, "ink" includes a liquid that, when applied onto a print medium, can form images, figures, patterns, and the like, can process the print medium, and can process ink. The process of ink includes, for example, solidifying or insolubilizing a coloring agent contained in ink applied to the print medium.

Further, a "print element" (also referred to as a "nozzle") generically means an ink orifice or a liquid channel communicating with an ink orifice, and an element for generating energy used to discharge ink, unless otherwise specified.

Furthermore, "ASIC" generally means an Application-Specific Integrated Circuit. ASIC, in this application, is not limited, however, to the meaning of an Application-Specific Integrated Circuit. ASIC in this specification may also indicate an integrated circuit in which circuits that implement a plurality functions are integrated.

<General Outline of Printing Apparatus (FIGS. 1 to 3C)>

Figure 1:
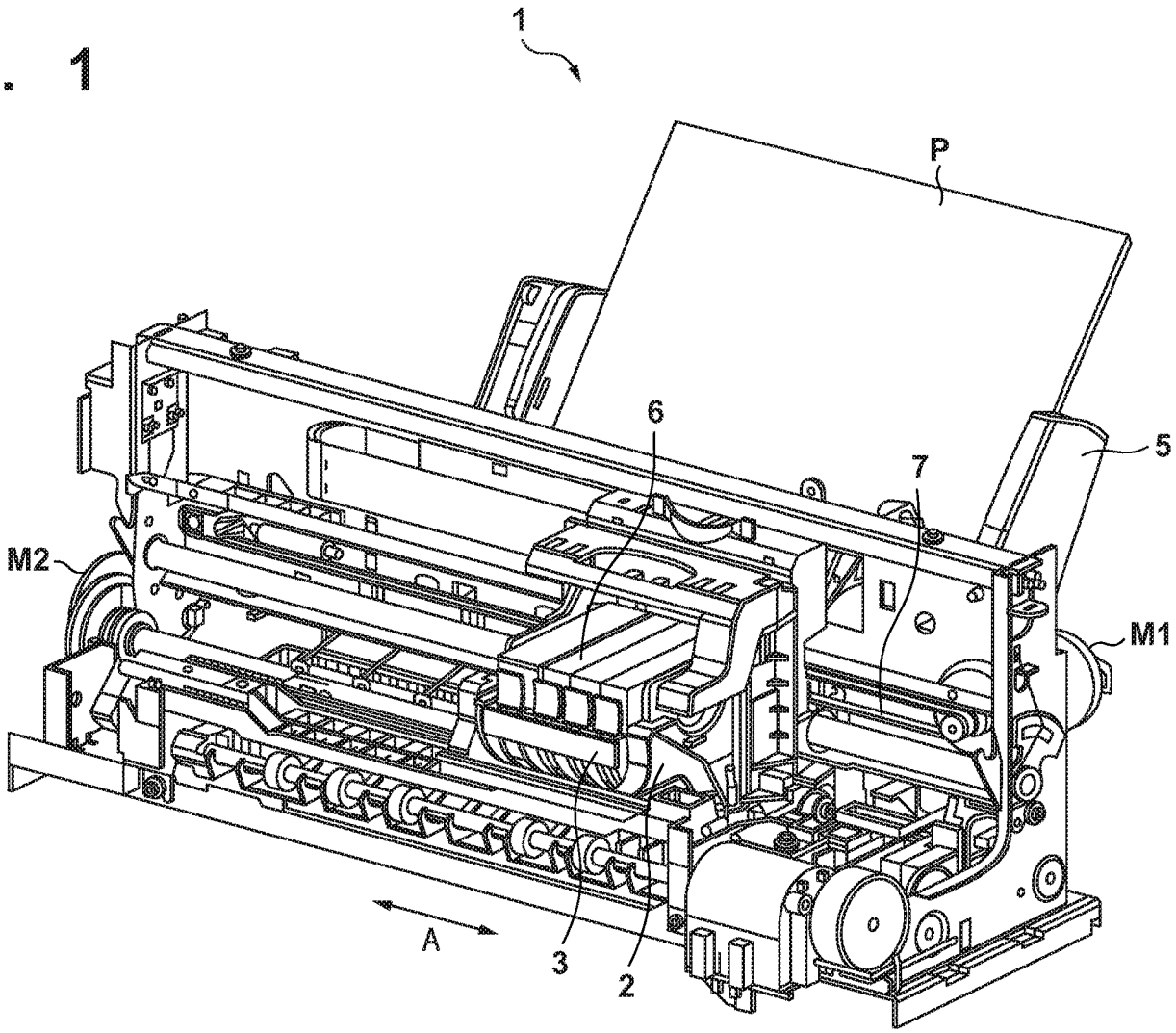
FIG. 1 is a perspective view schematically showing the outer appearance of an inkjet printing apparatus according to an embodiment of the present invention.

FIG. 1 is a perspective view showing the schematic arrangement of an inkjet printing apparatus 1 (also referred to as a printing apparatus) according to an embodiment of the present invention.

As shown in FIG. 1, the printing apparatus 1 mounts a carriage 2 to which an inkjet printhead 3 (referred to as a printhead) for performing printing by discharging ink in accordance with the inkjet method is attached, and performs printing by reciprocating the carriage 2 in directions indicated by an arrow A. A transfer mechanism 7 transfers, to the carriage 2, a driving force generated by a carriage motor M1, and the carriage 2 moves in the directions indicated by the arrow A. On the other hand, a print medium P, such as a print sheet, is fed via a paper feed mechanism 5, and is conveyed to a print position by the driving force of a conveyance motor M2. Ink is discharged from the printhead 3 to the print medium P at the print position, thereby performing printing.

In addition to the printhead 3, ink cartridges 6 each storing ink to be supplied to the printhead 3 are attached to the carriage 2 of a printing apparatus 1. Each ink cartridge 6 can be detachable from the carriage 2.

The printing apparatus 1 shown in FIG. 1 can perform color printing. To do this, four ink cartridges storing inks of magenta (M), cyan (C), yellow (Y), and black (K) are mounted on the carriage 2. The four ink cartridges are individually detachable.

The printhead 3 according to this embodiment adopts the inkjet method of discharging ink using heat energy. Thus, electrothermal transducers are included. The electrothermal transducers are provided in correspondence with respective orifices. A pulse voltage is applied to a corresponding electrothermal transducer in accordance with a print signal, thereby discharging ink from a corresponding orifice.

Embodiments of a power supply and a drive arrangement used in the printing apparatus having the above arrangement will be described next.

First Embodiment

Figure 2:
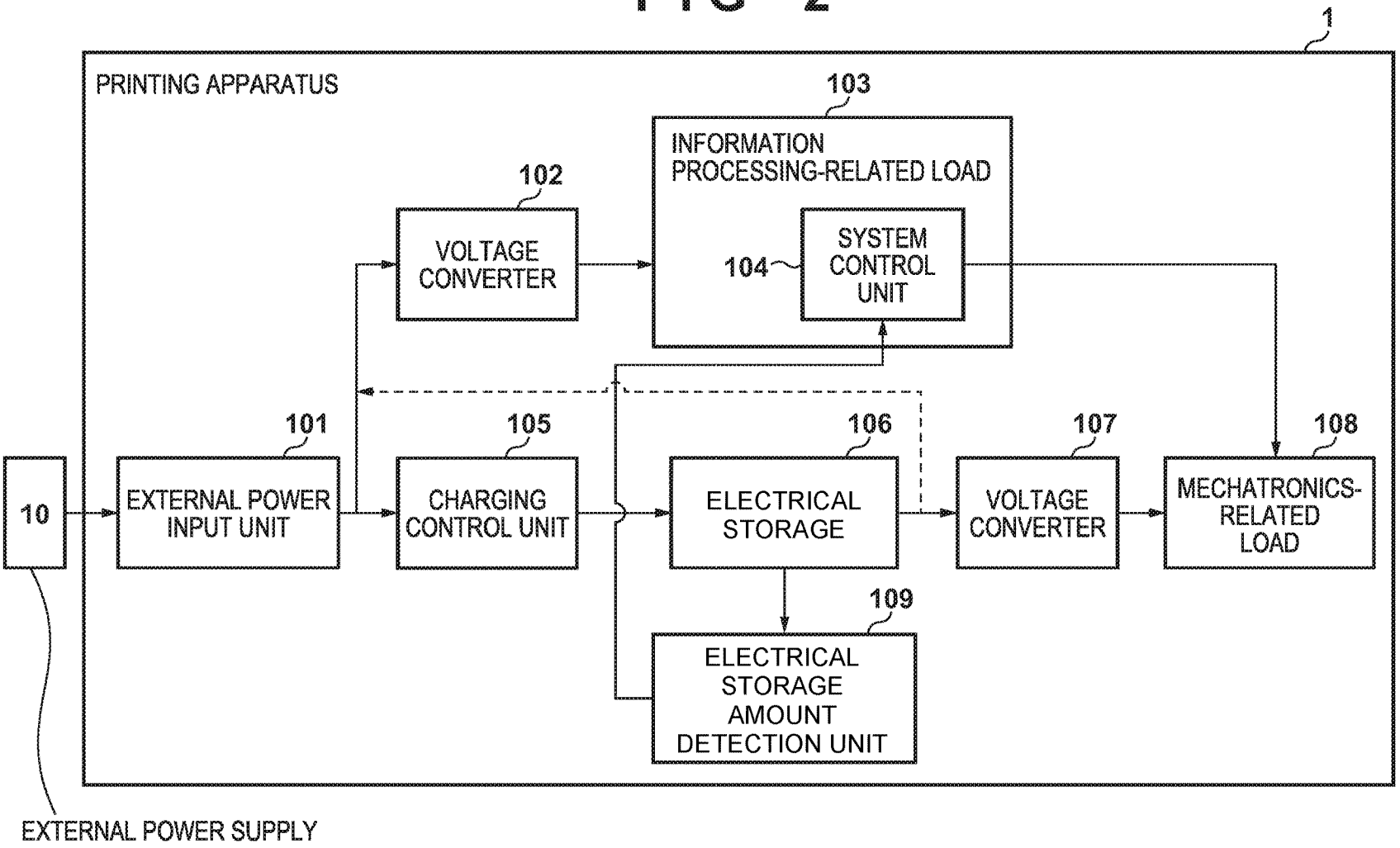
FIG. 2 is a block diagram schematically showing a power supply and a drive arrangement according to the first embodiment.

FIG. 2 is a block diagram schematically showing a power supply and a drive arrangement according to the first embodiment of the present invention.

An external power supply 10 shown in FIG. 2 is, for example, a PC having a USB terminal. In this example, a PC supporting USB 2.0 or USB 3.0 may be used. Alternatively, a PC, a charger, or the like, supporting a USB charging standard, such as Battery Charging Specification, or a supply of large power, such as USB Power Delivery, may be used. An AC adapter, or the like, without any USB interface may be adopted.

An external power input unit 101 is a connector for connection to the external power supply 10. Power obtained from the external power input unit 101 is supplied to a voltage converter 102 and a charging control unit 105, converted, by the voltage converter 102, into a voltage for driving a system load, and then is consumed by an information processing-related load 103. The information processing-related load 103 serves as a system control unit 104 including a memory and a CPU for performing the system control of the printing apparatus.

The charging control unit 105 charges an electrical storage 106 by power input from the external power input unit 101. The maximum charging current at this time is controlled so the sum of a current charged by the charging control unit 105 and a current consumed by the voltage converter 102 does not exceed the assumed acceptable current of the external power supply 10. It is required that the electrical storage 106 can be charged/discharged immediately, and hardly deteriorates due to repetitive charging/discharging. For example, an electrical double layer capacitor is desirably used. The charging control unit 105 determines a charging current value in consideration of the fact that the suppliable current of the external power supply 10 is not exceeded, as well as the charging capability of the charging control unit 105 and the maximum charging current of the electrical storage 106.

A voltage converter 107 converts the voltage of the electrical storage 106 into a voltage necessary for a mechatronics-related load 108. If an electrical double layer capacitor is used as the electrical storage 106, the stored charge amount is proportional to a terminal voltage, and thus, the terminal voltage largely lowers due to discharge. The voltage converter 107 desirably supports a wide input voltage range so as to be tolerable of a decrease in voltage caused by discharge of the electrical storage 106. The mechatronics-related load 108 is assumed to include a load whose driving can be stopped only at a limited timing, such as the print elements of the printhead 3 and the carriage motor M1 of the printing apparatus 1.

An electrical storage amount detection unit 109 detects the electrical storage amount of the electrical storage 106. A detection method should be appropriately selected depending on the type of the electrical storage 106, and may be implemented by, for example, estimating a charged charge amount by measuring the terminal voltage of the electrical storage 106 or by forming a Coulomb counter by monitoring the input/output current of the electrical storage 106.

The electrical storage amount detection unit 109 is connected to the system control unit 104, and uses the detected electrical storage amount as information for controlling charging/discharging. The operation/stop of mechatronics-related load 108 is controlled in accordance with determination of the system control unit 104.

In the printing apparatus having the above arrangement, if the external power supply 10 is connected to the external power input unit 101, power obtained from the external power input unit 101 is converted, by the voltage converter 102, into a voltage for the system load, and is supplied to the information processing-related load 103. On the other hand, power from which the system load current is subtracted is charged in the electrical storage 106 by the charging control unit 105. The electrical storage amount detection unit 109 monitors the electrical storage amount of the electrical storage 106. If the electrical storage 106 is charged to a predetermined value, the charging control unit 105 stops charging of the electrical storage 106.

The power charged in the electrical storage 106 is supplied to the mechatronics-related load 108 via the voltage converter 107. If the electrical storage amount of the electrical storage 106 becomes less than the predetermined value due to the operation of the mechatronics-related load 108, the charging control unit 105 continuously charges the electrical storage 106. With this operation, if the consumption power of the mechatronics-related load 108 is temporarily large, the power stored in the electrical storage 106 and the power input from the external power supply 10 are used together, thereby supplying large power.

Control for lowering the average consumption power to power suppliable by the external power supply 10 by stopping the mechatronics-related load 108 at an appropriate timing will be described with reference to timing charts shown in FIGS. 3A to 3C.

Figure 3A:
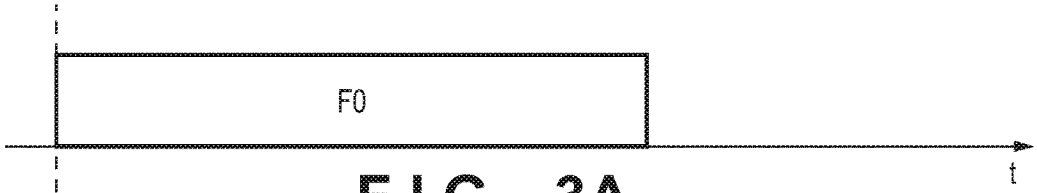
FIGS. 3A, 3B, and 3C are timing charts for explaining control for lowering average consumption power to power suppliable by an external power supply according to the first embodiment.

As shown in FIG. 3A, assume that there is a sequence F0 that requires no power supply control since power is sufficiently supplied from the external power supply 10. If the control according to this embodiment is applied to the sequence F0 and it is desirable to execute the same procedure with small power, sequences (F1 to F6) obtained by dividing the sequence F0 as much as possible are prepared, as shown in FIG. 3B. In this case, "as much as possible" indicates, if there is a temporal restriction under which a desired operation result can be obtained, division of the sequence within a range meeting the restriction.

Two examples of sequence division in the printing apparatus 1 will be described below.

[Sequence Division of Print Operation]

The printing apparatus performs printing by scanning the carriage 2 by driving of the carriage motor M1 and conveying the print medium P by driving of the conveyance motor M2. The typical driving sequence of the mechatronics-related load 108 includes the steps of:

(1) stopping the carriage 2;

(2) driving the carriage motor M1 to accelerate the carriage 2;

(3) discharging ink from the printhead 3 while scanning the carriage 2 at a constant speed;

(4) decelerating the carriage 2;

(5) driving the conveyance motor M2 to start conveyance of the print medium P; and (6) stopping conveyance of the print medium P.

By repeating the steps of (1) to (6), an image is formed on the entire print medium P.

In the above sequence, if the operation is temporarily stopped at a timing other than the timing at which the carriage 2 stops, the moving speed of the carriage 2 is different before and after the stop of the carriage 2, and thus, print unevenness may occur. Furthermore, while the carriage 2 stops, a capping member (not shown) caps the ink discharge surface of the printhead 3. If the operation is stopped at a timing other than the timing at which the carriage 2 stops, however, the ink discharge surface is exposed to the air during this period, thereby causing clogging of ink nozzles, or the like. To avoid this, it is necessary to execute the steps of (1) to (6) without stopping the carriage 2. Even after sequence division, the divided sequences need to be processed as a unified sequence, as shown in FIG. 3B. If, therefore, F0 represents a series of sequences for forming an image on the entire print medium P, the divided sequence F1 is a sequence including movement of the carriage 2 and conveyance of the print medium P for one scan. The divided sequences F2 to F6 are sequences sequentially executed by repeating the same processing as that of the divided sequence F1 five times.

[Sequence Division of Recovery Operation]

If the orifices of the printhead 3 are exposed to the air by the print operation, and then left for a long time, ink may be solidified in the orifices. Even if an attempt to supply energy to the print elements of the printhead 3 and to discharge ink is made in this state, the problem that no ink is discharged, or the like, may actually arise. To prevent this, it may be necessary to perform, before executing the print operation, an operation (recovery operation) of removing ink, and the like, that has solidified in the orifices of the printhead 3 and recovering the state to that suitable for ink discharge. To remove the solidified ink, a recovery unit provided in the printing apparatus 1 is operated. A recovery operation by the recovery unit includes a preliminary discharge by supplying energy to all the print elements, and a wiping operation of the printhead 3 using a printhead wiping mechanism included in the recovery unit.

An example of the sequence of the recovery operation includes the steps of:

(1) performing preliminary discharge by applying, a plurality of times, energy to all the print elements for discharging black (K) ink;

(2) wiping, a plurality of times, the discharge surface on which there are print elements for black (K) ink;

(3) performing preliminary discharge by applying, a plurality of times, energy to all the print elements for discharging color inks of magenta (M), cyan (C), and yellow (Y); and (4) wiping, a plurality of times, the discharge surface on which there are print elements for color inks of magenta (M), cyan (C), and yellow (Y).

In this sequence, with respect to the steps of (1) and (3), a temporal restriction is imposed on energy application, and thus, it is difficult to further divide each of the steps of (1)

and (3). To the contrary, with respect to the steps of (2) and (4), even if a standby time of about several seconds is inserted between a plurality of wiping operations, removal of solidified ink is hardly influenced, and it is relatively easy to divide each sequence for each wiping operation.

Therefore, if F0 represents the overall sequence of the recovery operation, for example, the sequence can be divided, as follows. That is, the sequence can be divided into the sequence F1 of a plurality of operations of applying energy for black (K) ink, the sequences F2 and F3 of wiping for black (K) ink, the sequence F4 of a plurality of operations of applying energy for color ink, and the sequences F5 and F6 of wiping for color ink.

The sequences F1 to F6, divided as in the above example, are executed every time an electrical energy $W_c(t)$ of the electrical storage 106 detected by the electrical storage amount detection unit 109 increases to a constant $W_{c1}$ prepared in advance. This automatically inserts a standby time for charging the electrical storage 106 between the sequences, as shown in FIG. 3C. As a result, the average consumption power of the mechatronics-related load 108 lowers, and thus, the operation can be performed in the same procedure as that of the sequence F0, even with limited input power.

Note that an electrical energy necessary to execute one sequence (for example, a print operation in one scan) is appropriately set as the constant $W_{c1}$. In this embodiment, the sequence is executed under the condition that the electrical energy $W_c(t)$ of the electrical storage 106 increases to the constant $W_{c1}$. Therefore, it is possible to prevent the operation from stopping due to a shortage of power during one sequence.

In the above example, the sequence of the print operation and the sequence of the recovery operation have been described. These sequences are necessary to print on the print medium. Therefore, these sequences may be collectively referred to as an operation sequence hereinafter.

Figure 3B:
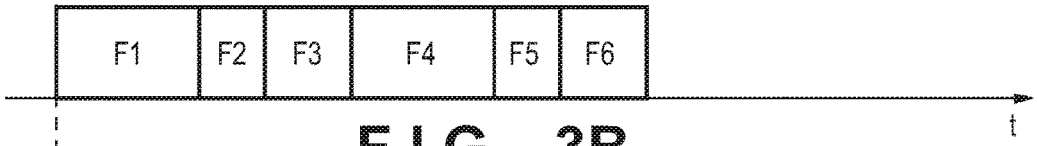
Figure 3C:
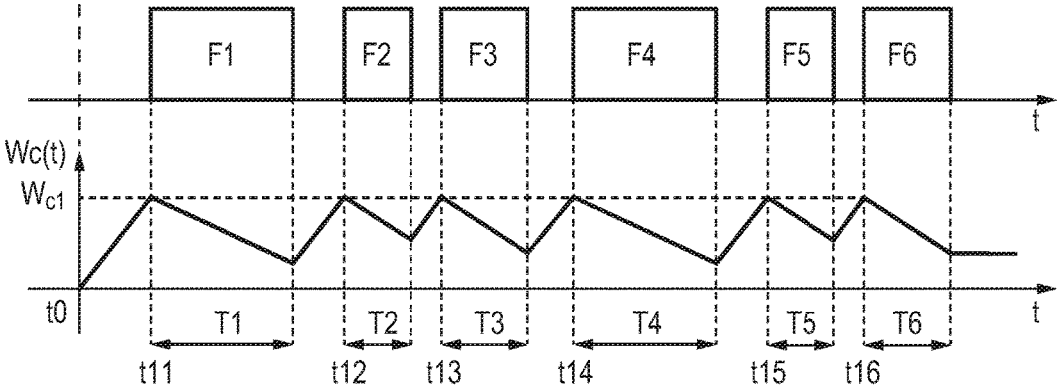
Figure 4:
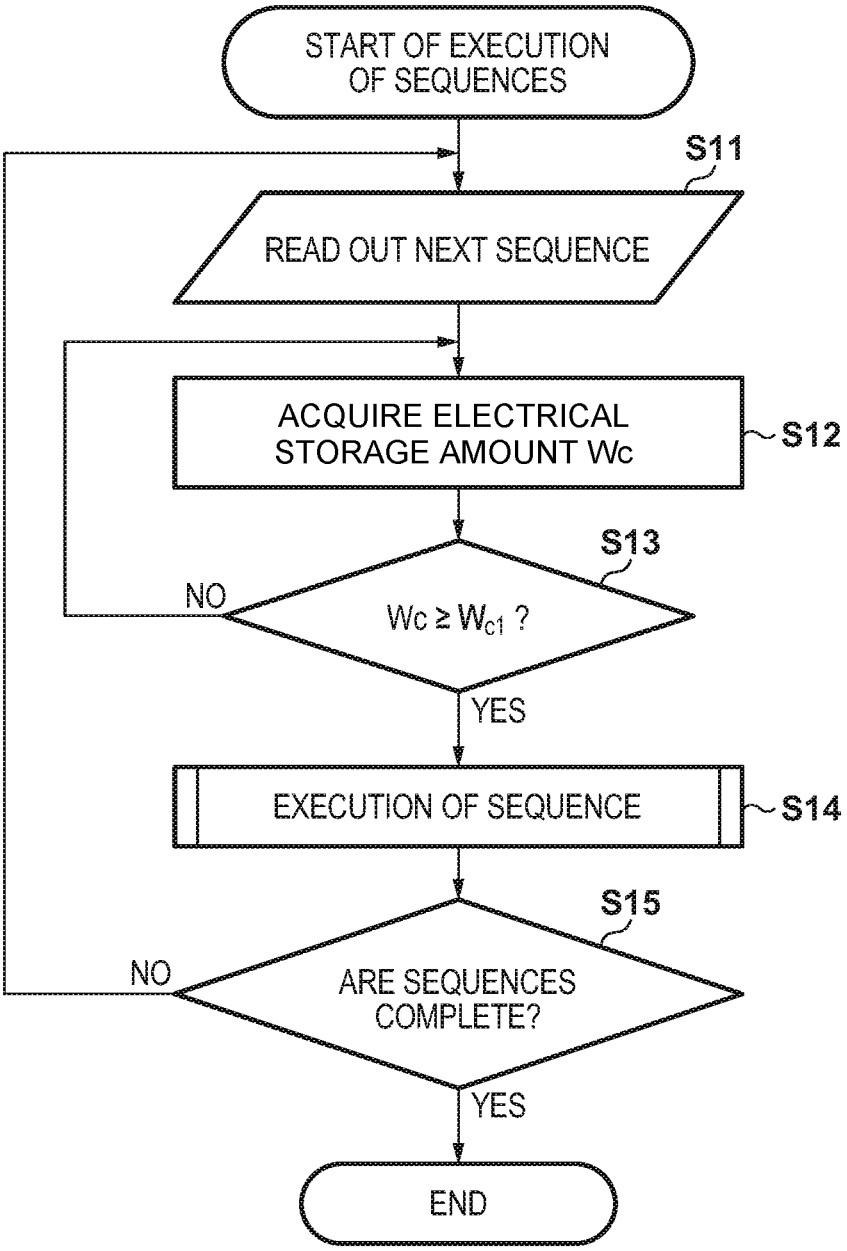
FIG. 4 is a flowchart illustrating standby time insertion processing by a system control unit according to the first embodiment.

FIG. 4 is a flowchart illustrating the standby time insertion processing by the system control unit 104. Note that in this processing, insertion processing starts at time t0 in FIGS. 3A to 3C.

In step S11, the contents of the first sequence F1 to be executed are read out. In step S12, an electrical storage amount $W_c$ is acquired from information of the electrical storage amount detection unit 109.

For example, an electrical double layer capacitor is used as the electrical storage 106, $W_c$ is obtained by:

$$W_c=(1/2)C(V^2-V_0^2) \quad (1),$$

where C represents the capacity of the electrical double layer capacitor, V represents the terminal voltage of the electrical double layer capacitor, and $V_0$ represents a lowest voltage to maintain a conversion operation by the voltage converter 107.

In step S13, $W_c$ is compared with the predetermined threshold $W_{c1}$. The process waits until the electrical storage amount $W_c$ increases to satisfy $W_c \geq W_{c1}$. Note that $W_{c1}$ is set so as to execute, with smallest input power assumed in consideration of the wiring resistance value of the external power supply 10, and the like, a sequence that imposes a heaviest load (the electrical energy is high and the execution time is short) assumed in the printing apparatus 1. For example, when Pi(min) represents the smallest input power, Wf(max) represents the consumption power of the sequence whose consumption power is the greatest, and T represents the time taken to execute the sequence, $W_{c1}$ is set to satisfy:

$$Pi(\min)\times T+W_{c1}>Wf(\max) \quad (2).$$

If the sequence indicates the print operation of one scan, the following electrical energy is set as Wf(max). More specifically, the consumption power when the carriage 2 reciprocates within the movable range of the carriage 2 and the printhead 3 performs printing on a print sheet of the maximum size supported by the inkjet printing apparatus 1 according to this embodiment using all the colors at the highest resolution is set.

After confirming that $W_c \geq W_{c1}$ is satisfied, the process advances to step S14 to execute the sequence F1.

This processing corresponds to time t0≤t<t11 in FIGS. 3A to 3C, and execution of the sequence F1 starts at time t=t11. After the end of execution of the sequence F1, completion confirmation processing is performed in step S15, and the process returns to step S11. Then, processing for the next sequence F2 starts at time t=t12. The same processing is executed until execution of the sequence F6 is completed. According to FIG. 3C, it takes T1 to complete the sequence F1 from time at t=t11, and it takes T2 to complete the sequence F2 from the time at t=t12. Likewise, it takes T3, T4, T5 and T6 to complete the sequences F3, F4, F5 and F6 from time at t=t13, t14, t15 and t16, respectively.

When charged to a predetermined voltage, the capacity of the electrical storage 106 is set to a value to ensure the electrical energy $W_{c1}$ even if the capacity decreases due to a deterioration, or the like.

In this embodiment, the power of the information processing-related load 103 is acquired from the input side of the charging control unit 105. This arrangement assumes that the information processing-related load 103 can sufficiently operate with power obtained from the external power supply 10 and no power support by the electrical storage 106 is necessary. Thus, no current consumed by the information processing-related load 103 flows into the charging control unit 105 and the electrical storage 106, and the current supply capability can be advantageously reduced. If the information processing-related load 103 needs support by the electrical storage 106, the input of the voltage converter 102 may be connected to the output of the electrical storage 106 (a dotted line in FIG. 2). In this case as well, standby time insertion processing can be implemented in the same manner by the flowchart shown in FIG. 4.

Therefore, according to the above-described embodiment, even if an electrical storage 106 of a small capacity is used, it is possible to perform printing by efficiently using the electrical storage 106 by sufficiently charging the electrical storage 106 every time a sequence is executed. Thus, even if the capacity of the electrical storage 106 is small, it is possible to perform printing by efficiently using the power. This contributes to cost reduction, downsizing, weight reduction, and the like of the printing apparatus 1.

Second Embodiment

Figure 5:
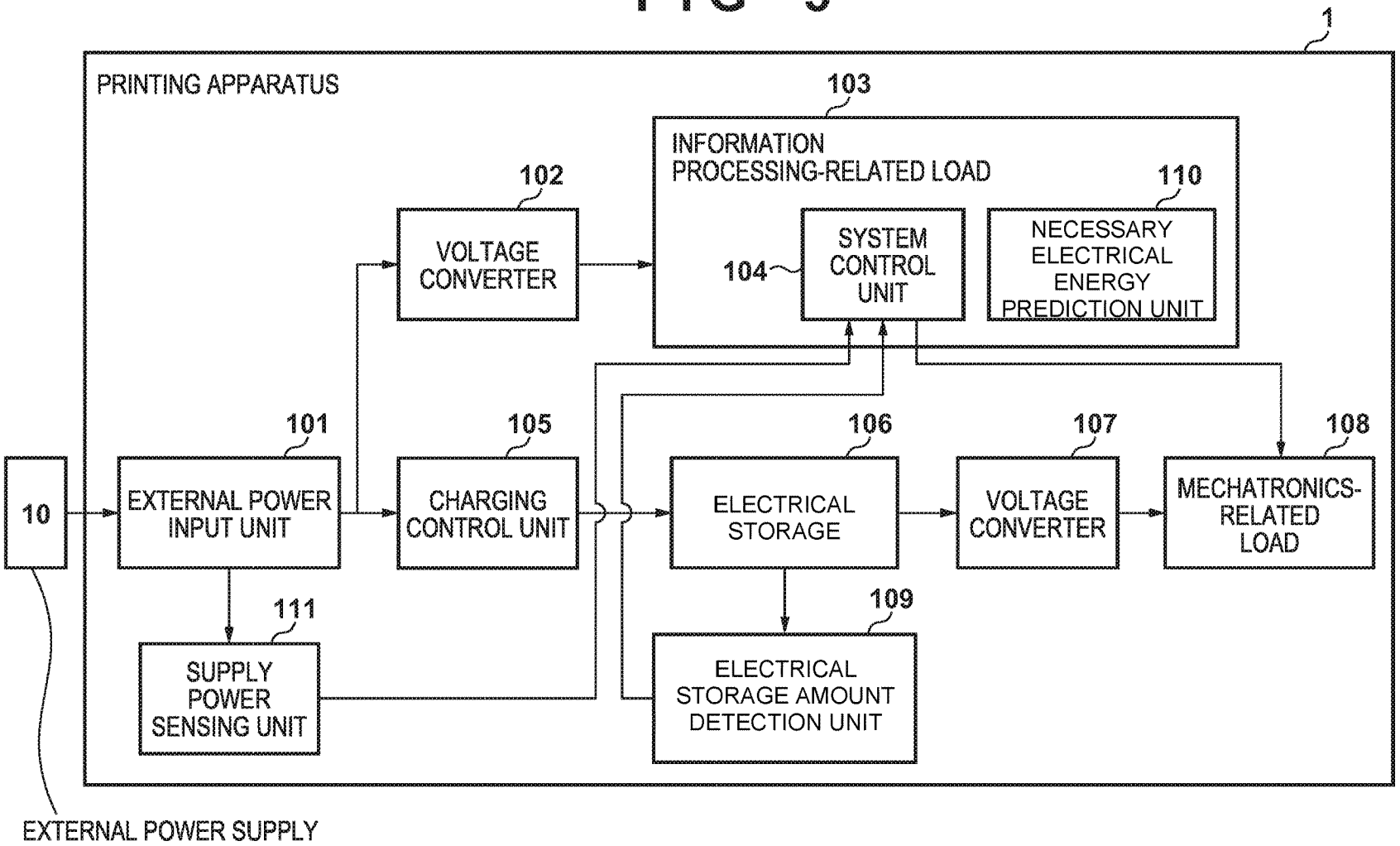
FIG. 5 is a block diagram schematically showing a power supply and a drive arrangement according to the second embodiment.

FIG. 5 is a block diagram schematically showing a power supply and drive arrangement according to the second embodiment of the present invention. Note that in FIG. 5, the same reference numerals as those in FIG. 2 denote the same components and a description thereof will be omitted.

A supply power sensing unit 111 senses/measures power suppliable from an external power input unit 101. Suppliable power is, desirably, automatically sensed at a time of connection to an external power supply 10. If, for example, the shape of the external power input unit 101 corresponds to USB, it is possible to discriminate between respective standards using a USB communication line. Alternatively, discrimination may be performed using communication individually determined with the external power supply 10, or the like, by utilizing a connector dedicated to the external power input unit 101.

With the supply power sensing unit 111 having the above arrangement, it is possible to appropriately set charging power by the charging control unit 105 with respect to different suppliable powers defined by a plurality of standards. In addition, the output capabilities of many of assumed external power supplies 10 are each defined by a current, rather than power, in many cases. Thus, it is desirable to measure a voltage in addition to logical discrimination of suppliable power. This can grasp the actual suppliable power in consideration of a voltage drop caused by a resistance component, such as a connector or cable, that connects the external power supply 10 and the external power input unit 101, thereby forming an arrangement tolerable of a variation in resistance component. The supply power sensing unit 111 is connected to a system control unit 104, similarly to an electrical storage amount detection unit 109, and uses the sensed power as information for executing standby time insertion processing according to this embodiment.

A necessary electrical energy prediction unit 110 predicts an electrical energy required at the time of execution of each divided sequence. In the first embodiment, the value of the electrical energy depending on the sequence that imposes the heaviest load is used as a fixed amount. In this embodiment, however, the value of the electrical energy predicted by the necessary electrical energy prediction unit 110 is used to execute control by the system control unit 104.

Figure 6A:
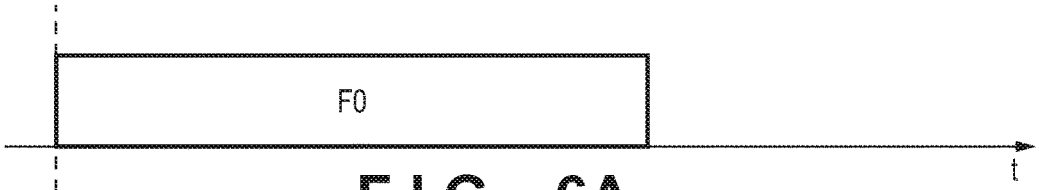
FIGS. 6A, 6B, and 6C are timing charts for explaining control for lowering an average consumption power to power suppliable by an external power supply according to the second embodiment.
Figure 6B:
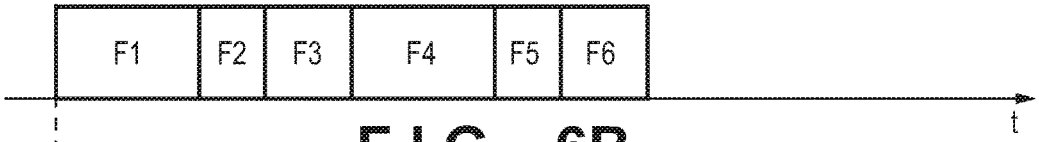
Figure 6C:
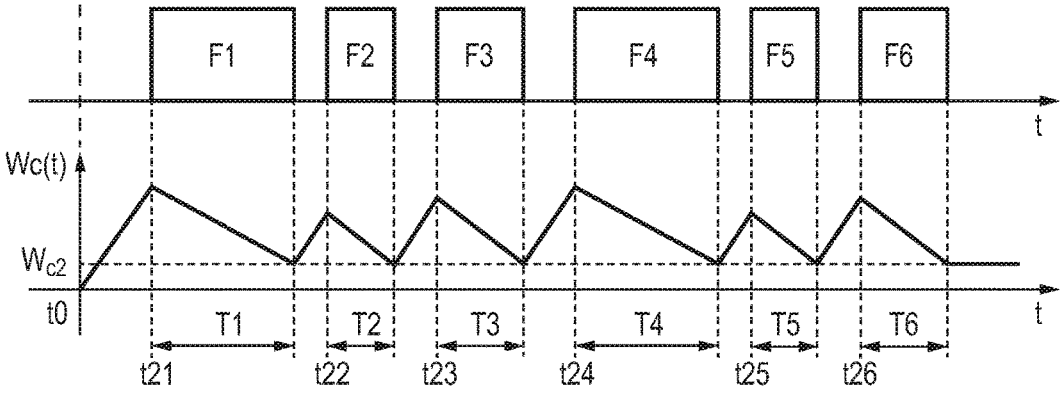

A method of lowering the average consumption power to power suppliable by the external power supply 10 in a printing apparatus 1 according to this embodiment will be described with reference to FIGS. 6A to 6C.

In this embodiment, during the standby state before executing the next sequence, only an electrical energy required by the next sequence is charged. A lowest electrical energy $W_{c2}$ as a charging criterion is a threshold determined based on a lowest input voltage to maintain the conversion operation of a voltage converter 107 using the power of an electrical storage 106. In this embodiment, as shown in FIG. 6C, an electrical storage amount to be charged before execution of the next sequence is calculated so an electrical storage amount $W_c(t)$ does not become less than $W_{c2}$ during execution of each sequence. In this embodiment, as shown in FIG. 6C, this calculation processing is performed every time a sequence is executed, and each sequence is executed after standing by until power is charged to the calculated value. More specifically, before execution of the next sequence, an electrical energy to be consumed until execution of the next sequence ends and an electrical energy to be supplied during execution of the sequence are predicted. Based on the predicted electrical energies, power is charged until it is determined that the electrical energy $W_{c2}$ is ensured at the end of the next sequence. Additional details will be described later. Note that the capacity of the electrical storage 106 is set so as to charge an electrical energy greater than $W_{c1}$ indicated by expression (2) in this embodiment as well. Note that since FIGS. 6A and 6B are identical to FIGS. 3A and 3B, respectively, the description will be omitted. T1, T2, T3, T4, T5 and T6 in FIG. 6C are the same as those shown in FIG. 3C. Times t21, t22, t23 t24, t25 and t26 in FIG. 6C mean the start times of the sequences F1-F6, respectively.

Figure 7:
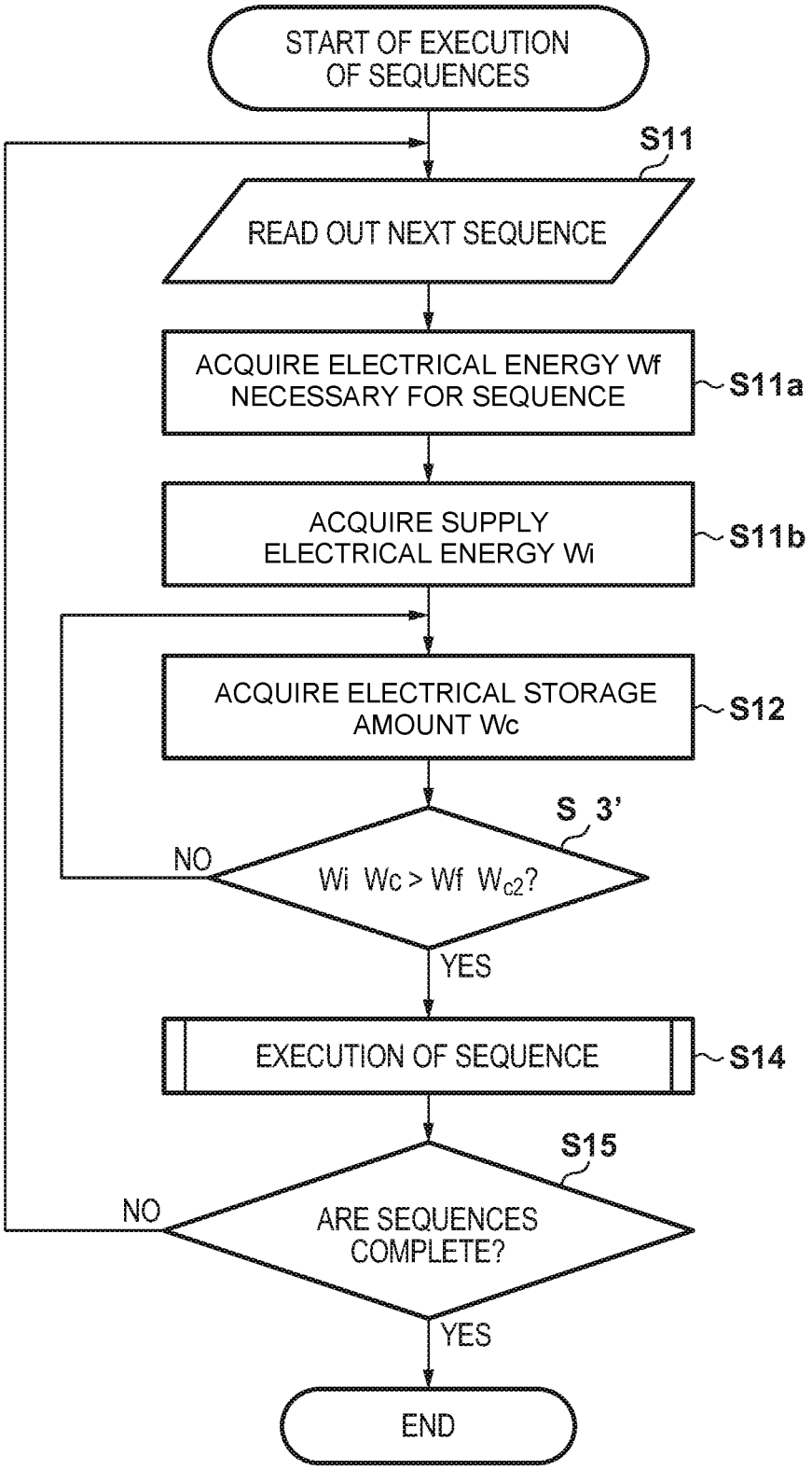
FIG. 7 is a flowchart illustrating standby time insertion processing by a system control unit according to the second embodiment.

FIG. 7 is a flowchart illustrating standby time insertion processing by the system control unit 104. Note that in FIG. 7, the same step numbers as those in FIG. 4 denote the same steps and a description thereof will be omitted. This embodiment is different from the above-described first embodiment in that a value to be compared with for processing in step S13' is changed, and steps S11*a* and S11*b* are added to acquire comparison contents.

In step S11*a*, the necessary electrical energy prediction unit 110 acquires an electrical energy Wf necessary for a sequence F1. A result of calculation under an operation condition given to the sequence F1, or the like, may be used as the value of Wf, or a numerical value based on actual measurement may be used as the value of Wf.

The printing apparatus 1 obtains the electrical energy Wf by the sum of an electrical energy required by ink discharge, an electrical energy of a carriage motor M1 to scan a carriage 2, and the like. The electrical energy required by ink discharge is obtained by the product of the number of ink dots discharged by a printhead 3 while the carriage 2 performs one reciprocal operation in directions indicated by an arrow A by a scan of the carriage 2 and an electrical energy necessary to discharge one dot. Note that the number of discharge dots is calculated from print data.

On the other hand, the electrical energy of the carriage motor M1 is not uniquely determined, unlike the electrical energy required by ink discharge from the printhead 3. The printing apparatus 1 according to this embodiment uses a DC motor with brushes as the carriage motor M1 while controlling the rotation speed by a servo mechanism. Thus, if the printing speed is set high, the rotation speed of the carriage motor M1 is set high, and the servo mechanism gives the carriage motor M1 high energy corresponding to the rotation speed.

As a result, the electrical energy necessary for the carriage motor M1 changes depending on the rotation speed of the carriage motor M1. The servo mechanism operates to reduce the influence of a variation in load caused by friction, or the like, when scanning the carriage 2, thus changing the energy to be given to the carriage motor M1. In this status, it is difficult to correctly predict in advance the necessary electrical energy before driving the carriage motor M1.

Therefore, in this embodiment, as an electrical energy for scanning the carriage 2, an empirical value based on actual measurement is stored in advance in the memory of the system control unit 104, and an information processing-related load 103 uses the stored electrical energy.

According to the above-described procedure, the system control unit 104 can obtain the value of Wf by calculating the sum of the electrical energy by ink discharge, obtained by the calculation described above, and the electrical energy, based on an actual measurement, for operating the carriage 2.

Next, in step S11*b*, a suppliable electrical energy Wi to be supplied during execution of the sequence is obtained based on information of supply power by the external power supply 10, obtained from the supply power sensing unit 111, and a time T1 necessary to execute the next sequence F1. For example, if the USB port of the PC is assumed as the external power supply 10, and a voltage drop caused by the USB connector or cable remains unchanged depending on time t, Wi is obtained by:

$$Wi = Vi \times Ii \times T1 \quad (3),$$

where Vi represents a terminal voltage measured by the supply power sensing unit 111, and Ii represents a maximum supply current value defined by the USB standard.

Subsequently, in step S13', an electrical energy ($Wi+W_c$) obtained during execution of the sequence is compared with the electrical energy Wf required by the sequence to be executed. If $Wi+W_c \leq Wf+W_{c2}$, the process returns to step S12. Then, the process waits until the electrical storage amount $W_c$ increases to satisfy $Wi+W_c > Wf+W_{c2}$. When it can be confirmed that $Wi+W_c > Wf+W_{c2}$ is satisfied, the process advances to step S14 to execute the sequence F1.

That is, in step S13', based on the electrical energy necessary for the next sequence and the electrical energy to be supplied during the next sequence, the system control unit 104 determines whether the charge amount $W_{c2}$ is ensured after execution of the next sequence. If it is determined that the charge amount $W_{c2}$ is ensured after execution of the next sequence (it is determined that a sufficient charge amount has been charged), the next sequence starts.

Therefore, in the above-described embodiment, if at least an electrical energy for a sequence to be executed next is ensured along with the progress of the operation sequence, the sequence is rapidly executed, thereby making it possible to execute each sequence as quickly as possible. This embodiment is effective especially when an electrical energy chargeable in the electrical storage is significantly high, as compared with the use electrical energy of each sequence.

Note that in the above-described embodiments, the printing apparatus 1 having the single function has been exemplified. The present invention is not limited, however, to a printing apparatus having a single function. For example, a multi-function printer (copying machine) including an image reading device (scanner device) in the above-described printing apparatus 1, or a multi-function peripheral implemented by adding a facsimile function to the copying machine may be used.

While the present invention has been described with reference to particular embodiments, it is to be understood that the invention is not limited to the disclosed embodiments. The scope of the following claims is to be accorded the broadest interpretation so as to encompass all such modifications and equivalent structures and functions.

What is claimed is:

1. A printing apparatus for printing an image on a print medium, the printing apparatus comprising:

an electrical storage configured to be charged by power input from an external power supply;

a print unit configured to sequentially execute, by discharging the power charged in the electrical storage, a plurality of sequences in an operation sequence for printing on the print medium;

a charge unit configured to charge the power in the electrical storage from a period beginning when execution of one sequence, among the plurality of sequences, by the print unit ends, until a next sequence, among the plurality of sequences, starts;

a prediction unit configured to predict an electrical energy amount necessary to execute the next sequence; and a control unit configured to control the print unit to execute the next sequence in a case in which an electrical storage amount of the electrical storage becomes greater than a threshold based on the electrical energy necessary to execute the next sequence, as has been predicted by the prediction unit, by charging of the electrical storage by the charge unit.

2. The printing apparatus according to claim 1, wherein the print unit includes:

a printhead with a plurality of print elements; and a carriage, incorporating the printhead, and being configured to move in a predetermined direction, wherein the print unit prints on the print medium using the printhead while scanning the carriage.

3. The printing apparatus according to claim 2, wherein the operation sequence is a sequence of a print operation of printing on the print medium, and each of the plurality of sequences includes (i) one scan of the carriage, and (ii) printing by the plurality of print elements included in the printhead, executed by the one scan.

4. The printing apparatus according to claim 2, wherein the printhead comprises an inkjet printhead configured to perform printing by discharging ink.

5. The printing apparatus according to claim 4, further comprising a recovery unit configured to recover the inkjet printhead, wherein the operation sequence is a sequence of a recovery operation of the inkjet printhead by the recovery unit, the sequence of the recovery operation includes (i) a preliminary discharge operation from the inkjet printhead, and (ii) a plurality of wiping operations on an ink discharge surface of the inkjet printhead, and the plurality of sequences includes the preliminary discharge operation and the respective wiping operations, of the plurality of wiping operations.

6. The printing apparatus according to claim 1, further comprising a conveyance unit configured to convey the print medium on which the print unit prints, wherein each of the plurality of sequences includes conveyance of the print medium by the conveyance unit.

7. The printing apparatus according to claim 1, wherein, based on print data used for printing in the next sequence, the prediction unit predicts the electrical energy necessary to execute the next sequence.

8. The printing apparatus according to claim 1, wherein the prediction unit acquires an electrical energy to be supplied during execution of the next sequence, and the control unit uses the threshold based on the electrical energy to be supplied during execution of the next sequence and the electrical energy necessary to execute the next sequence.

9. The printing apparatus according to claim 1, wherein the electrical storage comprises an electrical double layer capacitor.

10. The printing apparatus according to claim 1, wherein, based on the electrical energy necessary to execute the next sequence, predicted by the prediction unit, the charge unit charges the power in the electrical storage so that a charge amount of the electrical storage after execution of the next sequence is not less than a predetermined charge amount that is less than a charge amount of the threshold.

11. A control method for controlling a printing apparatus that prints an image on a print medium using power of an electrical storage charged by power input from an external power supply, the control method comprising the steps of:

sequentially executing, by discharging the power charged in the electrical storage, a plurality of sequences in an operation sequence for printing on the print medium;

charging power in the electrical storage from a period beginning when execution of one sequence, among the plurality of sequences, ends, until a next sequence, among the plurality of sequences, starts;

predicting an electrical energy amount necessary to execute the next sequence; and controlling operation to execute the next sequence in a case in which an electrical storage amount of the electrical storage becomes greater than a threshold based on the predicted electrical energy necessary to execute the next sequence by charging of the electrical storage.

12. The control method according to claim 11, wherein the printing apparatus includes a printhead with a plurality of print elements, and a carriage, incorporating the printhead, and being configured to move in a predetermined direction, and the printing apparatus prints on the print medium using the printhead while scanning the carriage.

13. The control method according to claim 12, wherein the operation sequence is a sequence of a print operation of printing on the print medium, and each of the plurality of sequences includes (i) one scan of the carriage, and (ii) printing by the plurality of print elements included in the printhead, executed by the one scan.

14. The control method according to claim 13, wherein the printing apparatus further includes a conveyance unit configured to convey the print medium, and each of the plurality of sequences includes conveyance of the print medium by the conveyance unit.

15. The control method according to claim 12, wherein the printhead comprises an inkjet printhead configured to perform printing by discharging ink, and the printing apparatus further includes a recovery unit configured to recover the inkjet printhead, and wherein the operation sequence is a sequence of a recovery operation of the inkjet printhead by the recovery unit, and the sequence of the recovery operation includes (i) a preliminary discharge operation from the inkjet printhead, and (ii) a plurality of wiping operations on an ink discharge surface of the inkjet printhead, and the plurality of sequences includes the preliminary discharge operation and the respective wiping operations.

16. The control method according to claim 11, wherein, in the predicting step, the electrical energy necessary to execute the next sequence is predicted based on print data used for printing in the next sequence.

17. The control method according to claim 11, wherein, in the predicting step, an electrical energy amount to be supplied during execution of the next sequence is acquired, and, in the controlling step, the threshold is based on the electrical energy to be supplied during execution of the next sequence, and the electrical energy necessary to execute the next sequence.

18. The control method according to claim 11, wherein, based on the predicted electrical energy amount necessary to execute the next sequence, in the charging step, the power in the electrical storage is charged so that a charge amount of the electrical storage after execution of the next sequence is not less than a predetermined charge amount that is less than a charge amount of the threshold.

* * * * *